US005927353A

United States Patent [19]

Persson et al.

[11] Patent Number: 5,927,353

[45] Date of Patent: Jul. 27, 1999

[54] FUNNEL FOR USE WITH REUSABLE PLASTIC CONTAINERS

[76] Inventors: Jens H. Persson, W333 W. Shore Dr., Mundelein, Ill. 60060; Charles W. Gay, 7815 Rock Hill La., Cincinnati, Ohio 45243; Jan A. Persson, 1524 Crabtree La., Deerfield, Ill. 60015

[21] Appl. No.: 08/974,181

[22] Filed: Nov. 19, 1997

[51] Int. Cl.[6] ..... B65B 1/04

[52] U.S. Cl. ..... 141/340; 141/331

[58] Field of Search ..... 141/331–345, 141/386, 383

[56] References Cited

U.S. PATENT DOCUMENTS

| | | | |
|---|---|---|---|
| 213,244 | 3/1879 | Pettibone . | |
| 475,874 | 5/1892 | Leggett . | |
| 641,267 | 1/1900 | Cahill . | |
| 661,681 | 11/1900 | Ashbaugh et al. | 141/340 |
| 959,715 | 5/1910 | Carson . | |
| 1,368,640 | 2/1921 | Melchior . | |
| 1,396,606 | 11/1921 | Vincent . | |
| 1,733,261 | 10/1929 | Higby et al. . | |
| 2,703,670 | 3/1955 | Voight . | |
| 2,811,181 | 10/1957 | Correll . | |
| 3,201,015 | 8/1965 | Wagaman | 141/332 |
| 3,874,429 | 4/1975 | LaFarge | 141/332 |
| 3,939,884 | 2/1976 | Mader . | |
| 5,168,908 | 12/1992 | Boyum . | |

*Primary Examiner*—Steven O. Douglas
*Attorney, Agent, or Firm*—Meroni & Meroni

[57] ABSTRACT

A funnel for use in connection with reusable plastic bottles or containers includes a body portion and a spout portion extending from the body portion to a lower open end. The spout portion is formed of downwardly extending inner and outer portions in spaced apart relation from one another to define a gap therebetween sized for receiving an upper portion of a fill spout of the plastic bottle. The outer portion has an interior surface facing the inner portion. A lower portion of the interior surface has an inwardly upwardly tapered portion adapted for receiving an outwardly extending portion of the fill spout in pressing engagement therewith to allow inward compression of the outwardly extending portion against the interior surface.

21 Claims, 3 Drawing Sheets

FUNNEL FOR USE WITH REUSABLE PLASTIC CONTAINERS

BACKGROUND OF THE INVENTION

1. Field of the Invention

The present invention relates generally to funnels. More particularly, the invention pertains to an improved and novel form of funnel for use with reusable plastic bottles or containers such that the funnel is engageable with the plastic container in a compression fitting to provide support of the funnel in an upright position.

2. Description of the Prior Art

Various forms of funnels or filling devices are known in the art for the transfer of flowable materials. Funnels of conventional design typically include a conically shaped body which tapers into a spout. The spout is then insertable into an inlet opening of a container, tank, or other vessel to facilitate filling.

Since it is undesirable to have spills occur during the transfer process of materials through the funnel, various forms of funnels have been designed to prevent this problem, as well as maintaining the relative position of the funnel with respect to the object being filled. Examples of such prior art funnels can be found in U.S. Pat. No. 1,368,640 issued to Melchior, U.S. Pat. No. 1,396,606 issued to Vincent, U.S. Pat. No. 1,733,261 issued to Higby et al., U.S. Pat. No. 2,703,670 issued to Voight, and U.S. Pat. No. 5,168,908 issued to Boyum.

In recent years, the use of translucent recyclable plastic containers in 1 and ½ gallon sizes have become especially popular for use by sellers of various products including milk, orange juice, and water. While such containers are formed of recyclable plastic, the abundance of these empty containers have raised numerous concerns among environmentalists. While in some circumstances the plastic containers are recycled, it has been found that in a majority of circumstances this is not the case. The reasons for such conditions include the fact that the plastic material used to form the containers can be just as inexpensively produced without relying on recycled materials and the fact that many individuals and communities simply choose not to recycle.

Accordingly, it is an object of the present invention to provide a funnel useable with such empty plastic containers to allow these containers to be directly recycled and reused for purposes of storing various contents for a user, such as coffee, beans, grain, seeds, powder and other flowable material or fluids. Further, the translucent containers allow for visibility of contents, contain airtight caps for resealing, as well as being suited for labeling and organizing in rows on shelves or in cabinets.

As a limitation of the prior art funnels, these funnels are not specially adapted for use with the translucent plastic containers as described above. Further, since plastic containers made by different manufacturers often contain filler spouts having differing external thread or spout configurations, it would be desirable to have a funnel which would be universally connectable with 1 and ½ gallon plastic milk or spout type containers made by all manufacturers.

As will be described in greater detail hereinafter, the funnel of the present invention solves the aforementioned problems and employs a number of novel features that render it highly advantageous over the prior art.

SUMMARY OF THE INVENTION

Accordingly, it is an object of this invention to provide a novel funnel designed for filling containers whereby contents can be conveyed through the funnel into the container without spillage.

Another object of this invention is to provide a funnel for use with recyclable milk or spout type plastic containers so that the plastic containers can be directly recycled by an end user to store other flowable materials therewithin.

Another object of this invention is to provide a funnel which is self-supporting on the container and is removably engageable with the container to form a compression fitting therebetween.

Still another object of this invention is to provide a funnel having a universal fitting for connection with 1 and ½ gallon milk or spout type plastic containers produced by various manufacturers.

Yet another object of this invention is to provide a funnel which is inexpensive to manufacture and can be formed by plastic molding techniques.

To achieve the foregoing and other objectives, and in accordance with the purposes of the present invention a funnel is provided for use in connection with plastic bottles or containers. The funnel includes a body portion and a spout portion extending from the body portion to a lower open end. The spout portion is formed of downwardly extending inner and outer portions in spaced apart relation from one another to define a gap therebetween sized for receiving an upper portion of a fill spout of the plastic bottle therewithin. The outer portion has an interior surface facing the inner portion. A lower portion of the interior surface has an inwardly upwardly tapered portion adapted for receiving an outwardly extending portion of the fill spout in pressing engagement therewith to allow compression of the outwardly extending portion against the interior surface as the outwardly extending portion is caused to move upwardly against the tapered portion for connection with the plastic bottle.

In accordance with an aspect of the invention, the tapered portion extends inwardly upwardly at an angle approximately 5° from a vertical plane.

Other objects, features and advantages of the invention will become more readily apparent upon reference to the following description when taken in conjunction with the accompanying drawings, which drawings illustrate several embodiments of the invention.

DETAILED DESCRIPTION OF THE PREFERRED EMBODIMENT

Figure 1:
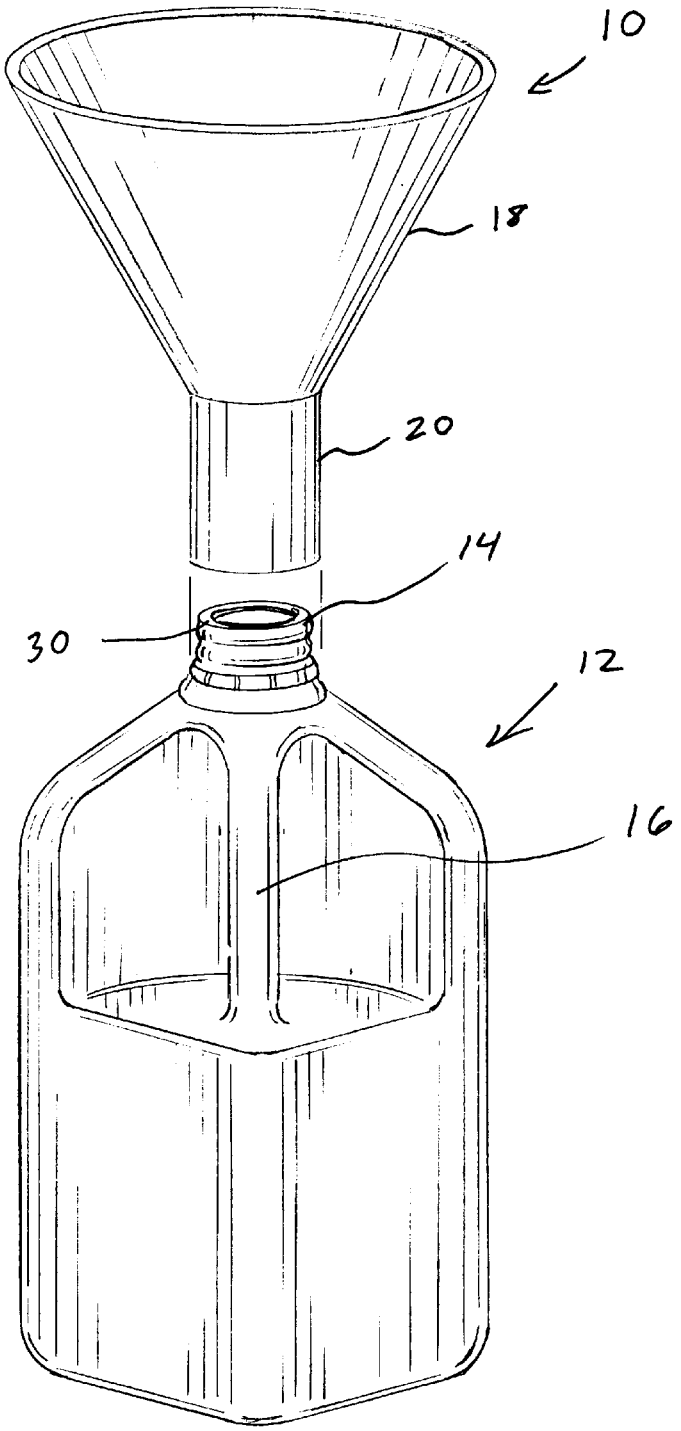
FIG. 1 is a perspective view of a funnel of the present invention for use with a plastic bottle.

Referring now to the drawings, a funnel or funnel structure 10 is illustrated in FIG. 1 for use in self-supported upright connection (FIG. 2) with a plastic bottle or container 12.

Preferably, the plastic container 12 is a recyclable plastic milk or spout type container having a vertically oriented fill spout 14 and handle 16 formed integral with the container 12. These recyclable plastic containers are commonly used to house milk, orange juice, water and the like and are therefore readily available to users when emptied and properly cleaned for use with the funnel 10 to store alternative contents such as coffee, beans, grain, seeds, powder and other flowable material or fluids. Further, the containers 12 are typically translucent which allows for visibility of contents, the containers 12 are provided with airtight caps for resealing, and are well suited for labeling and organizing in rows on shelves or in cabinets.

It may be appreciated that the present invention can be used with other containers such as plastic two liter bottles of the type used for soft drinks. However, the preferred embodiments of the present invention as shown in the drawings are directed for use with plastic milk type bottles or containers of 1 and ½ gallon variety, where such containers include a fill spout of greater diameter than other readily available recycled plastic containers so that a greater number of contents can be more readily used.

Figure 2:
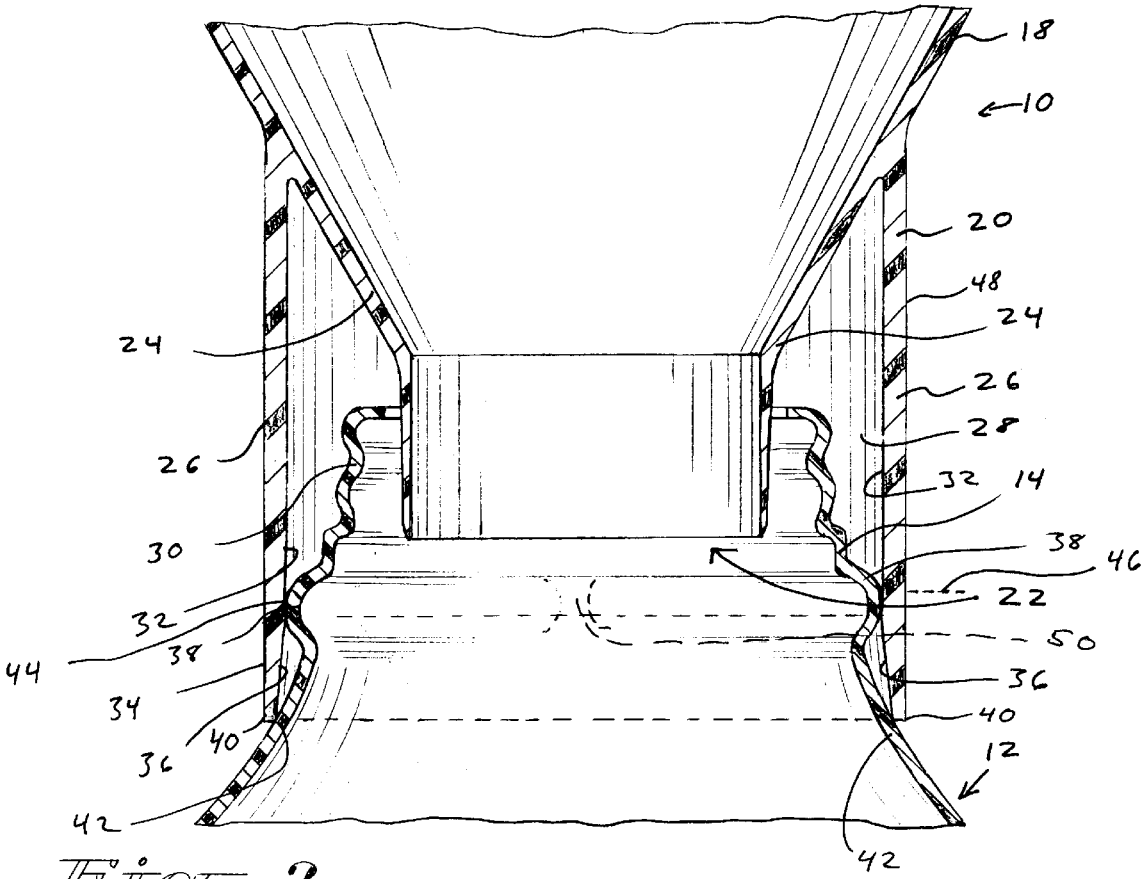
FIG. 2 is a sectional view of the funnel connected with the fill spout of the plastic bottle.
Figure 3:
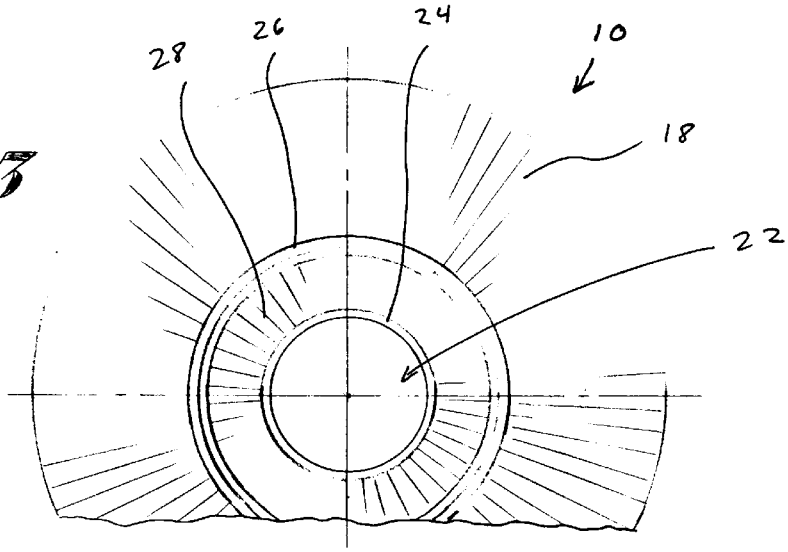
FIG. 3 is a bottom view of the funnel.

Referring to FIGS. 2 and 3, the funnel 10 includes a frusto-conical body portion 18 and a cylindrically shaped spout portion 20 extending from the body portion 18 to a lower open end 22. The spout portion 20 is formed of annular shaped downwardly extending inner and outer portions 24,26 in spaced apart relation from one another to define an open bottom annular gap or chamber 28 therebetween sized for receiving an annular upper portion 30 of the fill spout 14 of the plastic bottle or container 14 therewithin. A diameter of a lower end of the inner portion 24 is slightly less than an interior diameter of the fill spout 14 to allow the inner portion 24 to be inserted within the fill spout 14. A diameter of a lower end of the outer portion 26 is greater than an exterior diameter of the fill spout 14 to allow the outer portion 26 to telescopically extend over the upper portion 30 of the fill spout 14.

The outer portion 26 is formed of a rigid material having a density greater than that of the plastic bottle or container 12. In one preferred embodiment, the entire funnel 10 is molded of high density polypropylene plastic. The outer portion 26 has an annular shaped interior surface 32 facing the inner portion 24. A lower portion 34 of the interior surface 32 has a generally flat inwardly upwardly tapered portion or surface 36 extending circumferentially about the interior surface 32 and is adapted for receiving an outwardly extending portion 38 of the fill spout 14 in pressing engagement therewith to allow inward compression of the outwardly extending portion 38 against the interior surface 32 in a compression type fitting as the outwardly extending portion 38 is caused to move upwardly against the tapered portion 36 as the funnel 10 is inserted downwardly upon the bottle or container 12 for removable engagement therewith.

Preferably, once the funnel 10 is engaged upon the bottle or container 12, lower most edges 40 of the lower portion 34 are engaged in resting position against a top portion 42 of the container 12 extending about a perimeter of the fill spout 14, as best illustrated in FIG. 2. The lower most edges 40 thereby provide additional stability to the funnel 10 when secured to the container 12.

Figure 4:
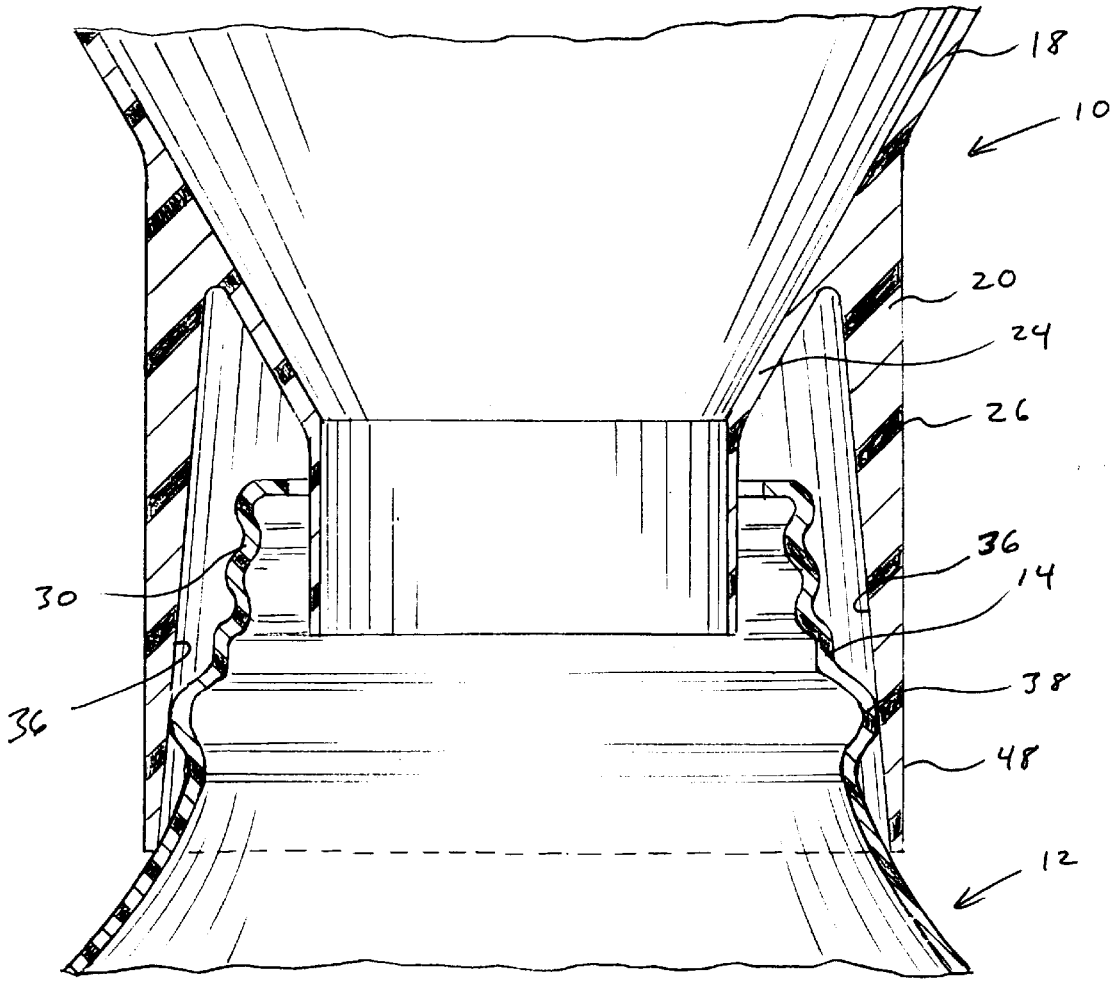
FIG. 4 is a sectional view of an alternative embodiment of the funnel.

Referring to FIG. 2, the outwardly extending portion 38 of the fill spout 14 comprises an annular collar extending substantially about the fill spout 14. The annular collar which is formed of relatively thin walled plastic, as shown in the drawings, is compressible against the interior surface 32 along a circumferential portion 44 of the interior surface 32 extending about a generally horizontal plane indicated by the numeral 46. While it should be understood that the interior surface 32 could be sized for compressed engagement with external threads of the fill spout 14, by engaging the annular collar portion of the fill spout 14, the funnel is now more universally adapted to secure with containers 12 having varied external thread configurations. It is also significant to note that air contained within the bottle or container 12 may escape between the inner portion 24 and fill spout 14, through the gap or chamber 28, and out between outer portion 26 and the annular collar at portions 50 where the annular collar does not compress against the interior surface 32. As shown in FIGS. 2 and 4, the inner portion 24 is sized and positioned remote from the outwardly extending portion 38 of the fill spout 14 to form a gap therebetween allowing an annular interior surface of the fill spout to remain spaced apart from the inner portion 24. A top lip of the fill spout 14 is spaced apart from the outer portion 26.

In the preferred embodiment shown in FIG. 2, the inwardly upwardly tapered portion 36 extends inwardly upwardly at an angle approximately 5° from a vertical plane indicated by the numeral 48. The tapered portion 36 extends upwardly at least ¼ inch. Referring to FIG. 4, an alternative embodiment of the funnel 10 is illustrated where the interior surface 32 is inwardly upwardly tapered substantially along its entire length.

Although the invention has been described by reference to some embodiments it is not intended that the novel device be limited thereby, but that modifications thereof are intended to be included as falling within the broad scope and spirit of the foregoing disclosure, the following claims and the appended drawings.

We claim:

1. A funnel for use in connection with plastic bottles, comprising: a body portion, a spout portion extending from the body portion to a lower open end, the spout portion being formed of downwardly extending inner and outer portions in spaced apart relation from one another to define a gap therebetween sized for receiving an upper portion of a fill spout of the plastic bottle therewithin, the outer portion being formed of a rigid material and having an interior surface facing the inner portion, a lower portion of the interior surface having an inwardly upwardly tapered portion adapted for receiving an outwardly extending portion of the fill spout in pressing engagement therewith to allow compression of the outwardly extending portion against the interior surface as the outwardly extending portion is caused to move upwardly against the inwardly upwardly tapered portion for connection with the plastic bottle with the inner portion sized and positioned remote from the outwardly extending portion of the fill spout to form a gap therebetween and the outer portion adapted for spaced apart positioning from a top lip of the fill spout.

2. The funnel of claim 1, wherein the spout portion is formed of a generally rigid material having a density greater than that of the plastic bottle.

3. The funnel of claim 2, wherein the funnel is formed of a molded high density polypropylene.

4. The funnel of claim 1, wherein the body portion is frusto-conically shaped and the spout portion is cylindrically shaped with the gap defined by the inner and outer portions being annular shaped.

5. The funnel of claim 4, wherein a diameter of a lower end of the inner portion is less than an interior diameter of the fill spout and a diameter of a lower end of the outer portion is greater than an exterior diameter of the fill spout.

6. The funnel of claim 1, wherein the outwardly extending portion of the fill spout comprises an annular collar extending substantially about the fill spout, the annular collar being compressible against the interior surface along a circumferential portion of the interior surface extending about a generally horizontal plane.

7. The funnel of claim 1, wherein the inwardly upwardly tapered portion extends inwardly upwardly at an angle approximately 5° from a vertical plane.

8. A funnel for use in self-supported connection with plastic milk type bottles having a fill spout, comprising: a frusto-conical body portion, a cylindrically shaped spout portion extending from the body portion to a lower open end, the spout portion being formed of annular shaped downwardly extending inner and outer portions in spaced apart relation from one another to define an open bottom annular gap therebetween sized for receiving an annular upper portion of the fill spout of the plastic bottle therewithin, the outer portion being formed of a rigid material and having an annular shaped interior surface facing the inner portion, a lower portion of the interior surface having a generally flat inwardly upwardly tapered portion extending circumferentially about the interior surface and adapted for receiving an outwardly extending portion of the fill spout in pressing engagement therewith to allow inward compression of the outwardly extending portion against the interior surface as the outwardly extending portion is caused to move upwardly against the inwardly upwardly tapered portion for removable engagement with the plastic bottle with the inner portion sized and positioned remote from the outwardly extending portion of the fill spout to form a gap therebetween and a top lip of the fill spout being spaced apart from the outer portion.

9. The funnel of claim 8, wherein the outwardly extending portion of the fill spout comprises an annular collar extending substantially about the fill spout, the annular collar being compressible against the interior surface along a circumferential portion of the interior surface extending about a generally horizontal plane.

10. The funnel of claim 9, wherein the inwardly upwardly tapered portion extends inwardly upwardly at an angle approximately 5° from a vertical plane.

11. The funnel of claim 10, wherein the inwardly upwardly tapered portion extends upwardly at least ¼ inch.

12. The funnel of claim 10, wherein a diameter of a lower end of the inner portion is less than an interior diameter of the fill spout and a diameter of a lower end of the outer portion is greater than an exterior diameter of the fill spout.

13. The funnel of claim 8, wherein the funnel is formed of a molded high density polypropylene.

14. A funnel for use in self-supported connection with recyclable plastic milk type containers having a vertically oriented fill spout, the funnel comprising: a frusto-conical body portion, a cylindrically shaped spout portion extending from the body portion to a lower open end, the spout portion being formed of annular shaped downwardly extending inner and outer portions in spaced apart relation from one another to define an open bottom annular gap therebetween sized for receiving an annular upper portion of the fill spout of the plastic bottle therewithin, a diameter of a lower end of the inner portion being less than an interior diameter of the fill spout, a diameter of a lower end of the outer portion being greater than an exterior diameter of the fill spout, the outer portion being formed of a rigid material and having an annular shaped interior surface facing the inner portion, a lower portion of the interior surface having a generally flat inwardly upwardly tapered portion extending circumferentially about the interior surface and adapted for receiving a substantially annular shaped outwardly extending portion of the fill spout in pressing engagement therewith to allow inward compression of the outwardly extending portion against the interior surface as the outwardly extending portion is caused to move upwardly against the inwardly upwardly tapered portion for removable engagement with the plastic bottle with the inner portion sized and positioned remote from the outwardly extending portion of the fill spout to form a gap therebetween and a top lip of the fill spout being spaced apart from the outer portion, lower most edges of the lower portion being engageable in resting position against a top portion of the container extending about a perimeter of the fill spout when the spout portion is engaged with the fill spout.

15. The funnel of claim 14, wherein the outwardly extending portion of the fill spout comprises an annular collar extending substantially about the fill spout, the annular collar being compressible against the interior surface along a circumferential portion of the interior surface extending about a generally horizontal plane.

16. The funnel of claim 15, wherein the funnel is formed of a molded high density polypropylene.

17. The funnel of claim 14, wherein the inwardly upwardly tapered portion extends inwardly upwardly at an angle approximately 5° from a vertical plane.

18. The funnel of claim 16, wherein the inwardly upwardly tapered portion extends upwardly at least ¼ inch.

19. A funnel and plastic bottle combination, comprising:

a plastic bottle having a fill spout, the fill spout having a compressible annular shaped outwardly extending portion, and a funnel structure having a body portion, a spout portion extending from the body portion to a lower open end, the spout portion being formed of downwardly extending inner and outer portions in spaced apart relation from one another to define a gap therebetween sized for receiving an upper portion of the fill spout of the plastic bottle therewithin, the outer portion being formed of a rigid material and having an interior surface facing the inner portion, a lower portion of the interior surface having an inwardly upwardly tapered portion adapted for receiving the outwardly extending portion of the fill spout in pressing engagement therewith causing compression of the outwardly extending portion against the interior surface with the inner portion sized and positioned remote from the outwardly extending portion of the fill spout to form a gap therebetween allowing an annular interior surface of the upper portion to remain spaced apart from the inner portion, a top lip of the fill spout being spaced apart from the outer portion, lower most edges of the lower portion engaging in resting position against a top portion of the plastic bottle extending about a perimeter of the fill spout.

20. The combination of claim 19, wherein the outer portion extends vertically from the lower most edges in resting position against the plastic bottle to the body portion at a spaced apart vertical distance from a top of the fill spout of the plastic bottle.

21. The combination of claim 20, wherein the inwardly upwardly tapered portion extends inwardly upwardly at an angle approximately 5°, a vertical cross-section of an outer surface of the inwardly upwardly tapered portion being flat and having a length of at least ¼ inch.

* * * * *